US008886070B2

(12) United States Patent
Yamashina

(10) Patent No.: US 8,886,070 B2
(45) Date of Patent: Nov. 11, 2014

(54) FIXING DEVICE FOR LOCALLY HEATING A FIXING MEMBER AND IMAGE FORMING APPARATUS INCORPORATING THE FIXING DEVICE

(75) Inventor: Ryota Yamashina, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 195 days.

(21) Appl. No.: 13/032,233

(22) Filed: Feb. 22, 2011

(65) Prior Publication Data

US 2011/0206402 A1 Aug. 25, 2011

(30) Foreign Application Priority Data

Feb. 22, 2010 (JP) ..... 2010-036522

(51) Int. Cl.
*G03G 15/20* (2006.01)

(52) U.S. Cl.
CPC .... *G03G 15/2078* (2013.01); *G03G 2215/2032* (2013.01); *G03G 2215/2009* (2013.01); *G03G 15/2089* (2013.01); *G03G 15/2017* (2013.01)
USPC ..... 399/69; 399/329; 399/331

(58) Field of Classification Search
CPC ..... G03G 15/2017; G03G 15/2078
USPC ..... 399/69, 329, 331
See application file for complete search history.

(56) References Cited

U.S. PATENT DOCUMENTS

| | | | | |
|---|---|---|---|---|
| 5,296,904 | A * | 3/1994 | Jackson | 399/328 |
| 5,907,348 | A * | 5/1999 | Ogasawara et al. | 347/212 |
| 6,393,230 | B1 * | 5/2002 | Haneda et al. | 399/69 |
| 2002/0031363 | A1 * | 3/2002 | Tomita et al. | 399/69 |
| 2005/0158088 | A1 * | 7/2005 | Someya et al. | 399/328 |
| 2006/0115305 | A1 * | 6/2006 | Lofthus et al. | 399/328 |
| 2006/0198646 | A1 * | 9/2006 | Funabiki et al. | 399/45 |
| 2008/0260408 | A1 * | 10/2008 | Takagi et al. | 399/69 |
| 2009/0297199 | A1 | 12/2009 | Yamashina et al. | |
| 2010/0061754 | A1 | 3/2010 | Ishigaya et al. | |
| 2010/0092220 | A1 | 4/2010 | Hasegawa et al. | |
| 2010/0092221 | A1 | 4/2010 | Shinshi et al. | |
| 2011/0064437 | A1 | 3/2011 | Yamashina et al. | |

FOREIGN PATENT DOCUMENTS

| | | |
|---|---|---|
| JP | 62-222281 | 9/1987 |
| JP | 2-140555 U | 11/1990 |
| JP | 05-006114 | 1/1993 |
| JP | 5-181370 A | 7/1993 |
| JP | 7-96616 A | 4/1995 |
| JP | 2001-51530 A | 2/2001 |
| JP | 2007-316544 | 12/2007 |
| JP | 4424475 | 12/2009 |

OTHER PUBLICATIONS

Office Action issued Sep. 3, 2013, in Japanese Patent Application No. 2010-036522.

* cited by examiner

*Primary Examiner* — Benjamin Schmitt
(74) *Attorney, Agent, or Firm* — Oblon, Spivak, McClelland, Maier & Neustadt, L.L.P.

(57) ABSTRACT

A fixing apparatus includes a fixing member that fixes a toner image onto a recording medium, a first heater that locally heats the fixing member by providing heat only to a portion of the fixing member corresponding to the toner image, and a pressing member that presses a recording medium against the fixing member. A second heater is provided to heat the pressing member.

10 Claims, 6 Drawing Sheets

FIG. 9A
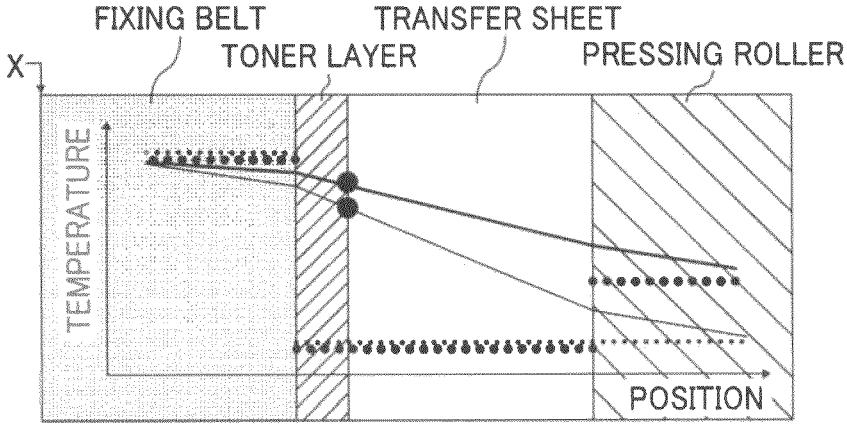
FIG. 9B
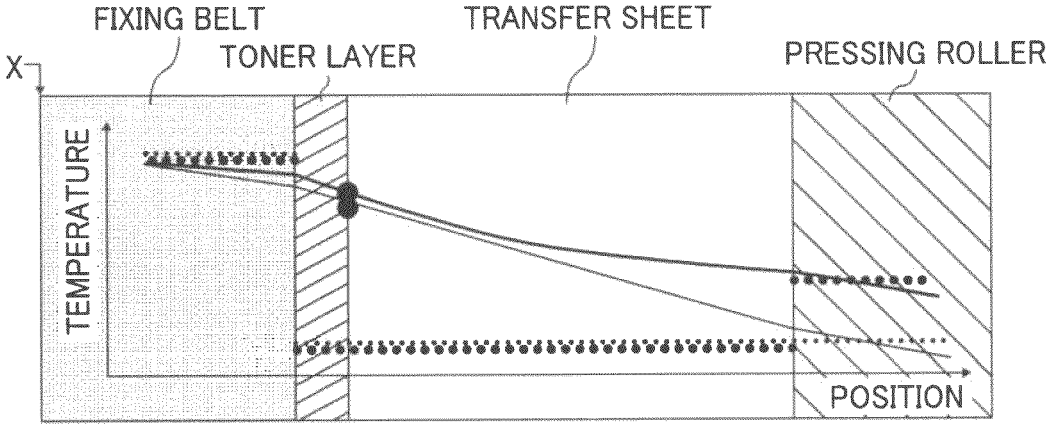
FIG. 10
| SHEET CATEGORY | THICKNESS t [μm] | CONTROL TEMPERATURE OF PRESSING ROLLER [°C] |
|---|---|---|
| THIN SHEET | t<66 | 60 |
| NORMAL SHEET | 66≦t<90 | 70 |
| MEDIUM SHEET | 90≦t<121 | 80 |
| FIRST THICK SHEET | 121≦t<190 | 100 |
| SECOND THICK SHEET | 190≦t<230 | 120 |
| THIRD THICK SHEET | 230≦t | 140 |

FIXING DEVICE FOR LOCALLY HEATING A FIXING MEMBER AND IMAGE FORMING APPARATUS INCORPORATING THE FIXING DEVICE

CROSS-REFERENCE TO RELATED APPLICATIONS

This application claims priority pursuant to 35 USC §119 to Japanese Patent Application No. 2010-36522, filed on Feb. 22, 2010, the entire contents of which are hereby incorporated by reference herein.

BACKGROUND OF THE INVENTION

1. Field of the Invention

The present invention relates to a fixing device capable of locally heating a fixing member, such as a fixing belt, etc., employed in an image forming apparatus, such as a copier, a facsimile machine, a printer, etc., and an image forming apparatus incorporating such a fixing device.

2. Description of the Background Art

Conventionally, it is known that a fixing device employed in an image forming apparatus, such as a copier, a facsimile machine, a printer, etc., includes a fixing member, such as fixing belt in a belt type fixing device, a fixing roller in a heat roller type fixing device, etc., to fix an image borne on a recording medium, such as a sheet, etc., a pressing member, such as a pressing roller, etc., and a heating device that heats the fixing member as described in Japanese Patent Application Laid Open Nos. H05-6114 and 2005-181946 (JP-H05-6114-A, and JP-2005-181946-A), respectively.

Such a heating device is categorized into two types. The first type extends over the entire width of the fixing member to uniformly heat thereof, and the second type locally heats the fixing member as described in JP-H05-6114-A and JP-2005-181946-A, respectively. In the first type, a halogen heater is utilized. In the second type, a thermal head is used.

Since heat travels from the fixing member and is stored in the pressing member due to uniform heating thereof in the first type, a heat source for heating the pressing member is frequently omitted in a fixing system.

However, since the recording medium is forcibly entirely heated in the fixing system having the first heating device, a blank portion of the recording medium, that is, a portion which does not bear any images, is needlessly heated, resulting in waste of energy.

By contrast, in a fixing system having the second heating device, since only an image bearing portion of the recording medium is heated, energy is not wasted, greatly saving power in comparison therewith.

However, since the heating device heats the fixing member so that the fixing member targets an image bearing portion of the recording medium, the pressing member hardly raises its own temperature. Consequently, heat applied to the fixing member by the heating device only for the purpose of fixing is quickly stripped off by the pressing member, thereby causing fixing malfunction.

Consequently, it is inconsistent with the purpose of reducing consumption of the power, but temperature of the pressing member may be previously increased to a prescribed level or calorie is increasingly supplied to the fixing member by the heating device. However, in the second system, when temperature of the fixing member is simply increased by the heating device from a low to high level, a difference in temperature of a boundary between the recording medium and a borne image thereon increases, resulting in insufficient or excessive glossiness even being capable of resolving the fixing malfunction. Specifically, a fixing performance and the glossiness are trade off.

SUMMARY OF THE PRESENT INVENTION

Accordingly, an object of the present invention is to provide a new and novel fixing apparatus that includes a fixing member to fix a toner image onto a recording medium, a first heater to locally heat the fixing member by providing heat only to a portion of the fixing member corresponding to the toner image, and a pressing member to press a recording medium against the fixing member. A second heater is provided to heat the pressing member.

In another aspect, the second heater is disposed against an external surface of the pressing member.

In yet another aspect, the pressing member is composed of a hollow roller, and the second heater is disposed inside the pressing roller.

In yet another aspect, a temperature detector is provided to detect temperature of the pressing member. A temperature control device is provided to control temperature of the pressing member to a target control level by controlling the second heater based on temperature detected by the temperature detector. The temperature of the pressing member is determined in accordance with a thickness of the recording medium.

In yet another aspect, a temperature detector is provided to detect temperature of the pressing member. A temperature control device is provided to control temperature of the pressing member to a target control level by controlling the second heater based on temperature detected by the temperature detector. The temperature of the pressing member is determined in accordance with a thickness of a toner layer carried on the recording medium.

In yet another aspect, the temperature detector detects temperature of a surface of the pressing member.

In yet another aspect, the second heater locally heats the pressing member by providing heat only to a portion of the pressing member corresponding to the toner image.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 9A-9B illustrate exemplary transitions of temperature of the fixing nip of the fixing device of FIG. 1 associated with a thickness of a recording medium; and FIG. 10 illustrates an exemplary table showing control temperature of the pressing member of the fixing device associated with the thickness of a recording medium according to one embodiment of the present invention.

PREFERRED EMBODIMENTS OF THE PRESENT INVENTION

Figure 1:
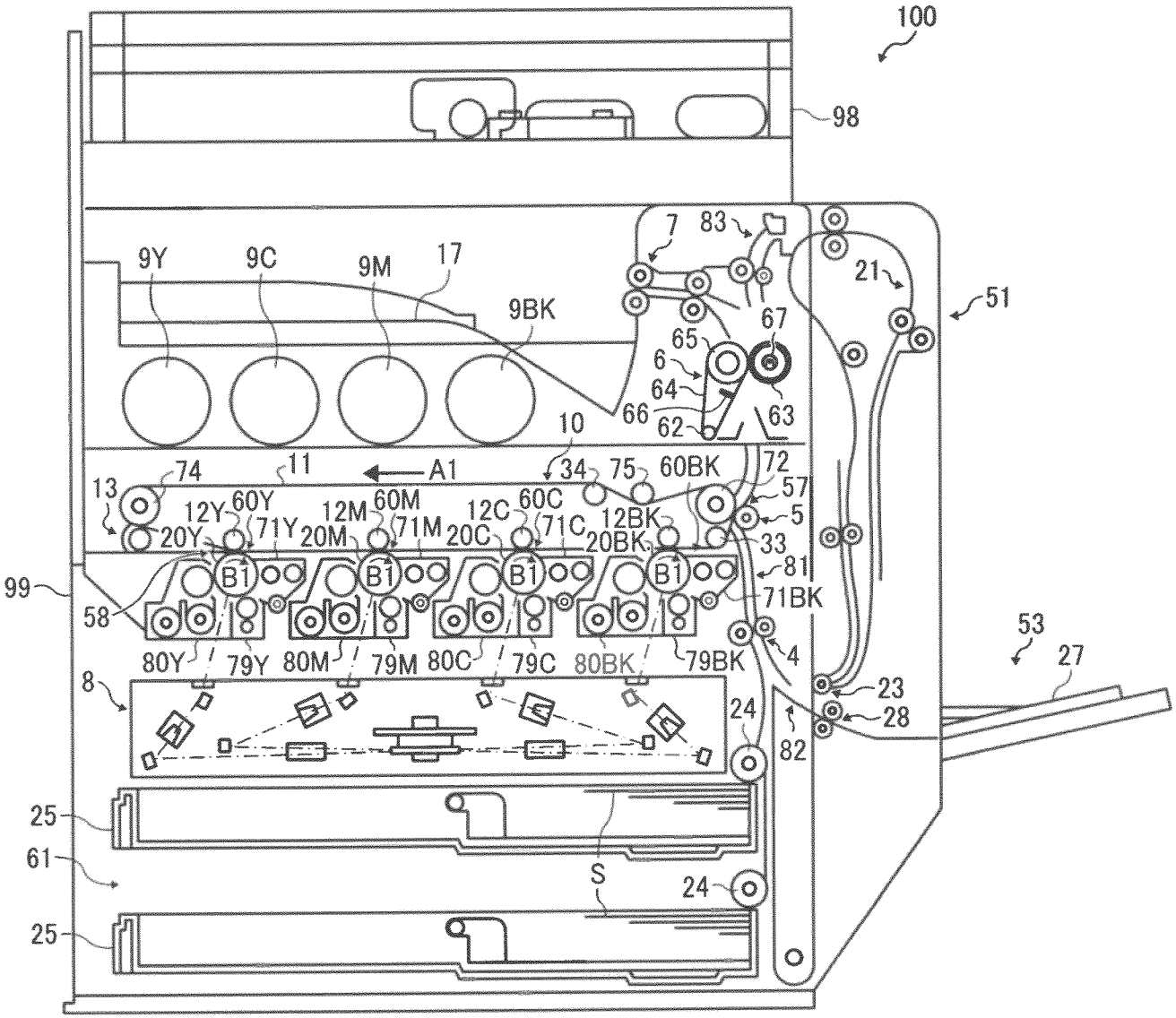
FIG. 1 is a schematic front view illustrating an exemplary fixing device employing one embodiment of the present invention and an image forming apparatus including the fixing device.

Referring now to the drawing, wherein like reference numerals designate identical or corresponding parts throughout several views, in particular in FIG. 1, an exemplary image forming apparatus 100 is described. A configuration of the fundamental image forming apparatus is substantially the same as that described in US Patent Application Publication No. 2010/0061754 (US-2010/0061754-A1), which is herein incorporated by reference.

Now, an exemplary fixing device is more specifically described.

The fixing device 6 includes an endless fixing belt 64, a fixing roller 65 winding the fixing belt 64 therearound, and a tension roller 62 continuously applying a prescribed tension to the fixing belt in corporation with the fixing roller 65. Also included are a pressing roller 63 disposed against the fixing roller 65 through the fixing belt 64 to form a fixing nip therebetween to press a transfer sheet S, a thermal head 66 serving as a first heat source to locally and separately heat the fixing belt, a halogen heater 67 serving as a second heat source to heat the pressing roller 63, and a spring, not shown, serving as a biasing device for forming the fixing nip.

The fixing belt 64 is made of heat resistant material, such as polyimide, etc., having a thickness of several tens of microns. One of rotation shafts of the fixing roller 65 and the pressing roller 63 is firmly disposed on the image forming apparatus with the0 other one of rotation shafts being freely separated therefrom. Consequently, by biasing the fixing roller 65 and the pressing roller 63 with the spring, the fixing nip is formed therebetween sandwiching the fixing belt 64. In short, the tension roller 62, the fixing belt 64, and the fixing roller 65 collectively constitute an endless type belt unit.

The thermal head 66 includes multiple numbers of a fine heater element and may be disposed in a widthwise direction of the fixing belt 64 over the width thereof with a density of 200 or 300 dots per inch.

The thermal head 66 is disposed inside the fixing belt 64 with the multiple numbers of the fine heater element contacting an inner surface thereof by a pressure of about 200 gram per centimeter in the widthwise direction of the fixing belt 64.

The pressing roller 63 is a thin hollow cylinder including the halogen heater 67 at its center. The halogen heater 67 is distanced from the pressing roller 63 extending over the width to heat thereof with radiation heat.

Thus, the halogen heater 67 is difficult to locally heat the pressing roller 63.

The fixing device 6 fixes a toner image onto a transfer sheet S with heat and pressure when the transfer sheet S passes through the fixing nip.

Now, an exemplary fixing process of heating toner using a thermal head 66 is described. When the thermal head 66 generates heat energy and heats the toner image borne on the transfer sheet S via the fixing belt 64 as described above, the heater elements of the thermal head 66 are controlled by a control device to generate heat as described later. Specifically, heat energy is continuously provided to the surface of the transfer sheet S via the fixing belt 64 with a pitch of about 80 micron from the leading end thereof to reach a prescribed level, so that the toner is fused and fixed.

Figure 2:
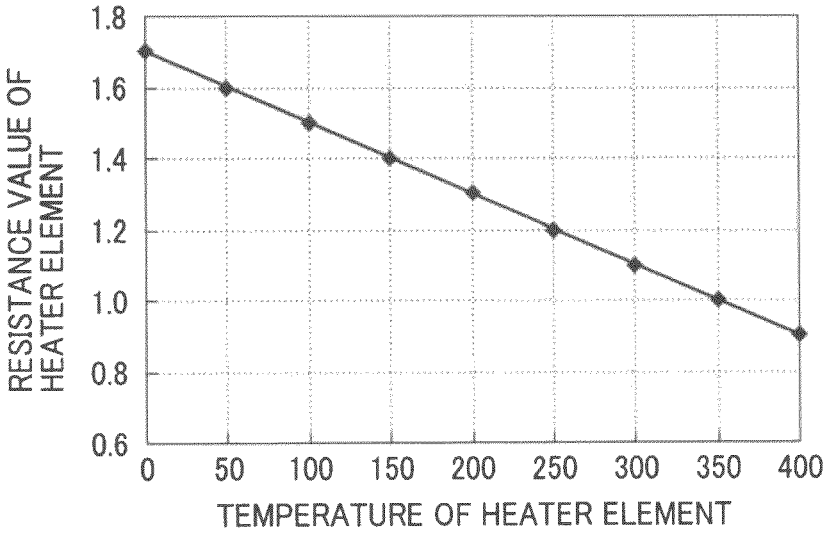
FIG. 2 illustrates an exemplary performance of a heater element employed in the fixing device of FIG. 1.

The thermal head 66 employs a system capable of detecting generated heat temperature per heater element every second by its own. Each of the heater elements is independent per dot, and is made of metal composed of alloy of Al, Cr, and Bo, and linearly changes a value of resistance in accordance with the temperature as shown in FIG. 2. Based on this performance, temperature of each of the heater elements is detected every second by its own. Thus, a fixing operation is executed by controlling temperature of the heater elements in the thermal head with the above described configuration.

Figure 3:
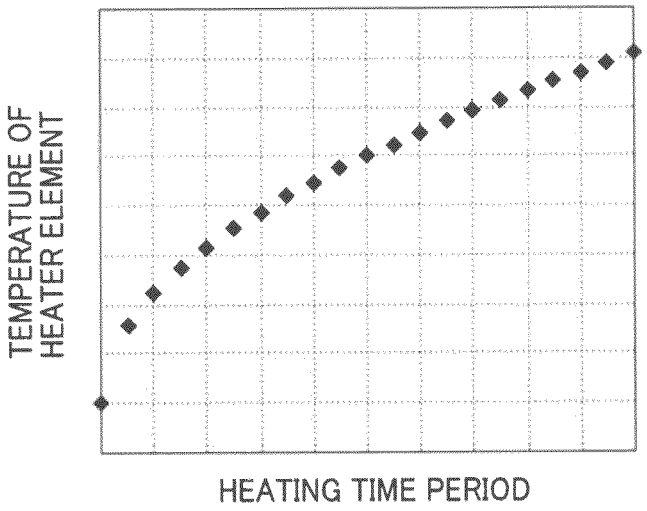
FIG. 3 illustrates another exemplary performance of a heater element employed in the fixing device of FIG. 1.

Now, an exemplary relation between a heating time period and a detected temperature of the thermal head 66 is described with reference to FIG. 3. As shown, temperature of the heater elements of the thermal head 66 increases as a heating time period increases. Such heating is continued up to a prescribed energy level per heater element, and is immediately stopped at the level.

In this way, upon receiving from the thermal head 66, the fixing belt 64 transports a prescribed calorie to the fixing nip temporarily and the toner image finally. Instead of the halogen heater 67, the other heat source such as a ceramic heater, an induction heating device (IH), etc., can be employed as the second heat generation device. Remaining devices of the fixing device are described later in detail.

Respective toner particles of yellow, cyan, magenta, and black stored in the toner bottles 9Y to 9Bk are polymerization types. A prescribed amount of the toner particle is ejected from each of the respective toner bottles 9Y to 9Bk to developing devices 80Y to 80Bk included in image formation units 60Y to 60Bk described later in detail via conveyance paths, such as a pipe, etc., when rotated by a driving device, not shown.

A reading device 98, not shown, includes a platen glass for receiving an original document thereon, a light source for emitting a light to the original document placed on the platen glass, and a first reflection member for reflecting a light reflected from the original document. Further included are a first carriage reciprocating left and right as shown in FIG. 1 having a first reflection member for reflecting a light reflected from the original document, a second carriage having a second reflection member for reflecting a light reflected from the first carriage member, and an imaging lens for imaging the light reflected from the second carriage. Further included is a reading sensor for receiving the light passing through the imaging lens and reading a content of the original document based thereon and the like.

The image formation units 60Y to 60Bk have substantially the same configuration to each other. Specifically, the respective image formation units 60Y to 60Bk include primary transfer rollers 12Y to 12Bk for executing primary transfer processes, cleaning devices 71Y to 71 Bk for executing cleaning processes, charge removing devices, not shown, for removing charges therefrom, charging devices 79Y to 79Bk for executing AC charging, and developing devices 80Y to 80Bk for developing latent images with two component developer disposed in a rotation direction B1 (i.e., clockwise in FIG. 1) as process devices around the photoconductive drums 20Y to 20Bk.

The photoconductive drum 20Y, the cleaning device 71Y, the charge removing device, the charge device 79Y, and the developing device 80Y are integrated to collectively constitute a process cartridge. Respective surroundings of the photoconductive drums 20M to 20Bk are also integrated to collectively constitute the same or another process cartridge. These process cartridges can be detachably attached in rotational axis directions of the photoconductive drums 20Y to 20Bk at a front side in FIG. 1 when a front panel is opened. Due to possibility of handling as replacement parts, making into a process cartridge significantly preferably improves user friendliness.

In such an image forming apparatus 100, image formation may be practiced by the below-described process by depressing a start switch in each of the respective image formation units 60Y to 60Bk. Specifically, when a signal instructing color image formation is inputted, the reading device 98 appropriately reads an original document to obtain data corresponding to an image to be formed. Then, the driving roller 72 starts driving, and accordingly the transfer belt 11, a cleaning opposition roller 74, suspending rollers 33 and 34, and the tension roller 75 are driven and rotated, while the photoconductive drums 20Y to 20Bk are driven and rotated.

As the photoconductive drums 20Y to 20Bk rotate in the direction B1, the charging devices 79Y to 79Bk uniformly charge the surfaces of those. Then, based on data corresponding to images to be formed, the control device drives an optical scanning device 8 to emit and executes scanning of laser light, so that latent images for yellow to black colors are formed on the respective photoconductive drums. The latent images are then developed by the respective developing devices 80Y to 80Bk with the yellow to black toner particles, so that toner images of respective monochrome colors are formed.

The thus developed yellow to black toner images are sequentially transferred and superimposed by the primary transfer rollers 12Y to 12Bk onto the same position on the transfer belt 11 rotating in a direction A1, so that a synthesized color image is formed thereon.

Further, upon receiving a signal input instructing color image formation, one of sheet feeding rollers 24 and 28 for respective sheet feeding cassettes 25 and a manual sheet feed tray 27 is selectively driven and rotated to launch and separate transfer sheets S therefrom one by one. The thus conveyed transfer sheet S then stops colliding with a pair of registration rollers 4. When a duplex image is formed, a transfer sheet S bearing a fixed image on its one side passes through an inversion conveyance path 21 and is reversed up side down. The transfer sheet S is then collides and stops at the pair of registration roller 4 in the fixing device 6.

The pair of registration rollers 4 rotate in synchronism with the synthesized color image borne on the transfer belt 11 that reaches the secondary transfer section 57 as its rotates in the direction A1. Then, the synthesized color image tightly contacts the transfer sheet S launched into the secondary transfer section 57 and receives a secondary transfer process under a nip pressure to be recorded thereonto.

The transfer sheet S is further conveyed by the secondary transfer device 5 and the transfer belt 11 rotating in the direction A1 and is launched into the fixing device 6. The toner image of the synthesized color image borne on the transfer sheet S is fixed thereonto by heat and pressure when passing through the fixing device 6.

The transfer sheet S passing through the fixing device 6 with a synthesized color image being fixed thereon is ejected outside an apparatus body 99, and is stacked on a sheet ejection tray 17 disposed on the upper section thereof. When a duplex image is formed, a transfer sheet S bearing a fixed image on its one side is conveyed toward the pair of registration roller 4 again via a twice sheet feeding path 82 and the inversion conveyance path 21.

The respective photoconductive drums 20Y to 20Bk are subjected to cleaning processes of cleaning devices 71 UY to 71 Bk to remove post transfer toner remaining thereon after transfer processes, and are then subjected to charge removal processes. The respective photoconductive drums 20Y to 20Bk are then subjected to the next charging processes of the charging devices 79Y to 79Bk.

The transfer belt 11 passing through the secondary transfer section 57 and subjected to the secondary transfer process there is then subjected to a cleaning process of a cleaning member provided in the cleaning device 13 to receive cleaning of its surface to prepare for the next transfer.

Now, an exemplary operation of the thermal head 66 as one embodiment of the present invention is described in detail. When all of the heater elements are driven regardless of a position of toner borne on the transfer sheet S, the blank portion and a non sheet passage region thereof are heated wasting energy. To resolve such a problem, a driving time for driving each of the heater elements is controlled by a control device so as to heat a fixing belt 64 corresponding to a position of toner borne on the transfer sheet S. Specifically, the control device drives each of the heater elements based on data corresponding to an image to be formed as in the same manner as the optical scanning device 8 is driven. In short, to heat the toner on the transfer sheet S entering the fixing nip with the fixing belt 64 rotating and reaching the fixing nip, the control device selectively drives the plural heater elements at appropriate times in accordance with positions of the toner particles on the transfer sheet S. Consequently, regions of the fixing belt 64 corresponding to the toner image on the transfer sheet S both in the widthwise and rotational directions thereof are heated. Accordingly, the control device functions as a first heating device drive controlling device, a heater element selection drive controlling device, and a fixing member heat controlling device.

Now, a modification of the above-described embodiment is described. Even being fluctuated by a pitch of the plural heater elements and a responding velocity of heat generation thereof, the thermal head 66 targets and heats only the region of the fixing belt 64 corresponding to the toner image on the transfer sheet S in this way. Thus, the heat for the non sheet passage region is omitted and is widely saved in comparison with the conventional halogen heater type incapable of local heating. When temperature of the pressing roller 63 is low, heat provided by the thermal head 66 to the fixing belt 64 for the purpose of fixing is immediately stripped off by the pressing roller 63, thereby causing a fixing malfunction as shown in FIG. 4.

Figure 4A:
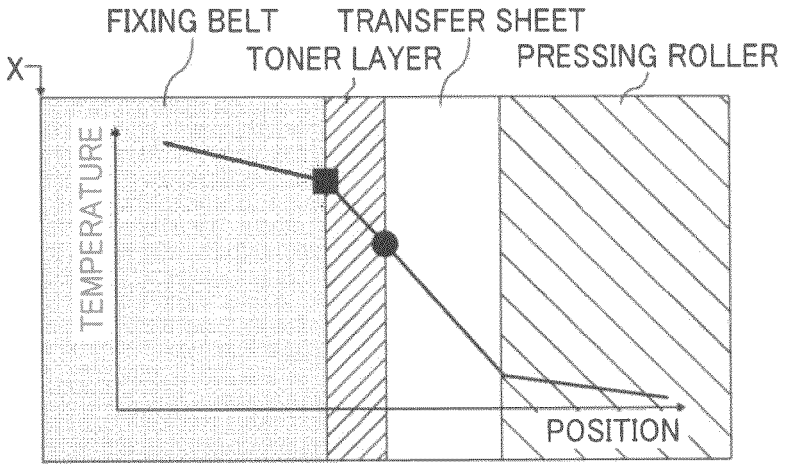
FIGS. 4A-4C illustrate exemplary transitions of temperature in a fixing nip of the fixing device of FIG. 1 when a sheet passes therethrough.
Figure 4B:
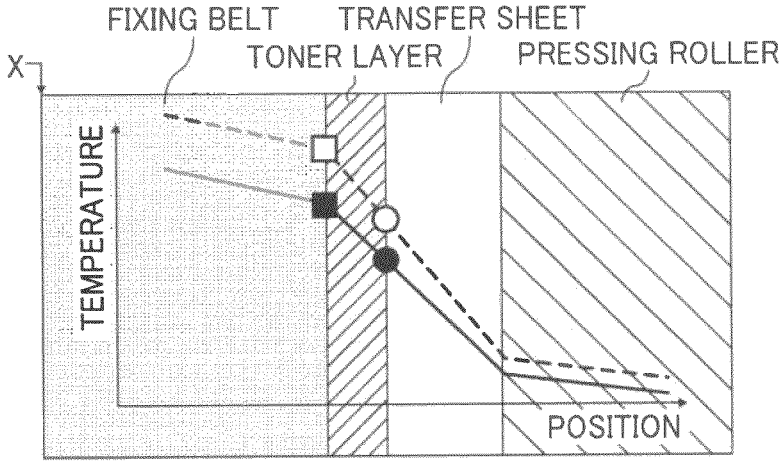
Figure 4C:
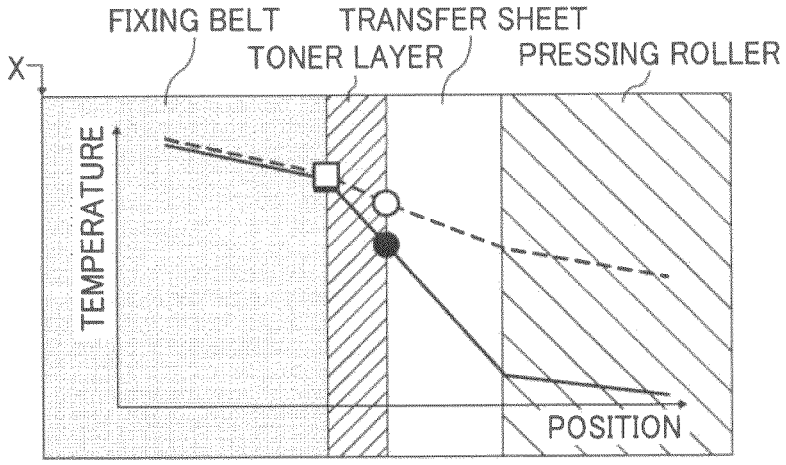

Such a phenomenon is now described more in detail with reference to FIGS. 4A-4C. As shown, a lateral axis represents a position of the fixing belt 64 in the fixing nip in a thickness direction thereof. Whereas, a vertical axis represents temperature in the direction. As understood therefrom, temperature transition appears when traveling through the fixing belt 64, a toner layer on the transfer sheet S, the transfer sheet S, and the pressing roller 63 in the thickness direction of the fixing belt 64 when the transfer sheet S having the toner image passes through the fixing nip. In the drawing, an arrow X points a rear surface position of the fixing belt heated by the thermal head 66. A black dot points a first boundary face existing between a transfer sheet S and a toner image. A black square points a second boundary face existing between the toner image and a fixing belt 64.

As shown in FIG. 4A, since the fixing belt 64 is heated and accordingly temperature thereof is high while temperatures of the transfer sheet S and the pressing roller 63 are relatively lower than that, temperature inclines from surface of the fixing belt 64, i.e., the toner boundary face or the second boundary face, toward the surface of the pressing roller 63 via the first boundary face, i.e., the sheet-toner boundary face.

In general, a fixing performance of toner onto a transfer sheet S is closely related to temperature of the sheet-toner boundary face. Accordingly, to obtain a prescribed desirous fixing performance, temperature of the sheet-toner boundary face needs to be sufficiently increased. For this purpose, the thermal head 66 may need to supply a sufficient amount of heat from an inside to an outside of the fixing belt 64 so that the heat travels to the second and first boundary faces via the toner layer and increases the sheet-toner boundary temperature to a prescribed level.

Further, a glossiness as one of factors affecting a quality of a fixed image is closely related to temperature of the second boundary face. Accordingly, to obtain fine glossiness, the temperature of the second boundary face needs to enter within a prescribed appropriate range.

For this purpose, below described two methods can be employed. The first method is to increase calorie to be supplied from the thermal head 66 to increase surface temperature of the fixing belt 64 as shown in FIG. 4B. Otherwise, surface temperature of the pressing roller 63 is increased as shown in FIG. 4C.

When the first method is utilized, the sheet-toner boundary face temperature increases from the black dot to a white dot by increasing the surface temperature of the fixing belt 64 as shown in FIG. 4B. However, the temperature of the second boundary face, i.e., the toner surface, increases at the same time from a black solid square to a white square marks. When the temperature of the second boundary face is excessively increased, the glossiness either excessively increases or decreases due to an excessive amount of the calorie sometime. Specifically, a trade off relation appears in which a demand for glossiness cannot be satisfied when a fixing performance is satisfied by excessively increasing the sheet-toner boundary face temperature.

When the second method is utilized, the sheet-toner boundary face temperature increases from the black dot to a white dot by increasing the surface temperature of the pressing roller 63 with a moderate inclination of temperature from the fixing belt 64 to the pressing roller 63 as shown in FIG. 4C. Since temperature of the second boundary face does not substantially change, the trade off relation can be resolved such that the sheet-toner boundary face temperature increases satisfying appropriate glossiness.

As a result, it is recognized as follows. Since heat travels from the fixing member, such as a fixing belt 64, etc., to a pressing member, such as a pressing roller 63, etc., as the fixing member rotates in a conventional fixing system that entirely heats the fixing member, temperature of the pressing member increases to more than a prescribed level, and a trade off problem is not serious. By contrast, according to this embodiment in which the fixing member is locally heated, the trade off problem seriously appears, and accordingly temperature of the pressing member needs to be increased.

Thus, the halogen heater that heats the pressing roller 63 is useful to a system that employs the thermal head 66 that locally heats the fixing belt corresponding to the image region on the transfer sheet S.

Figure 5:
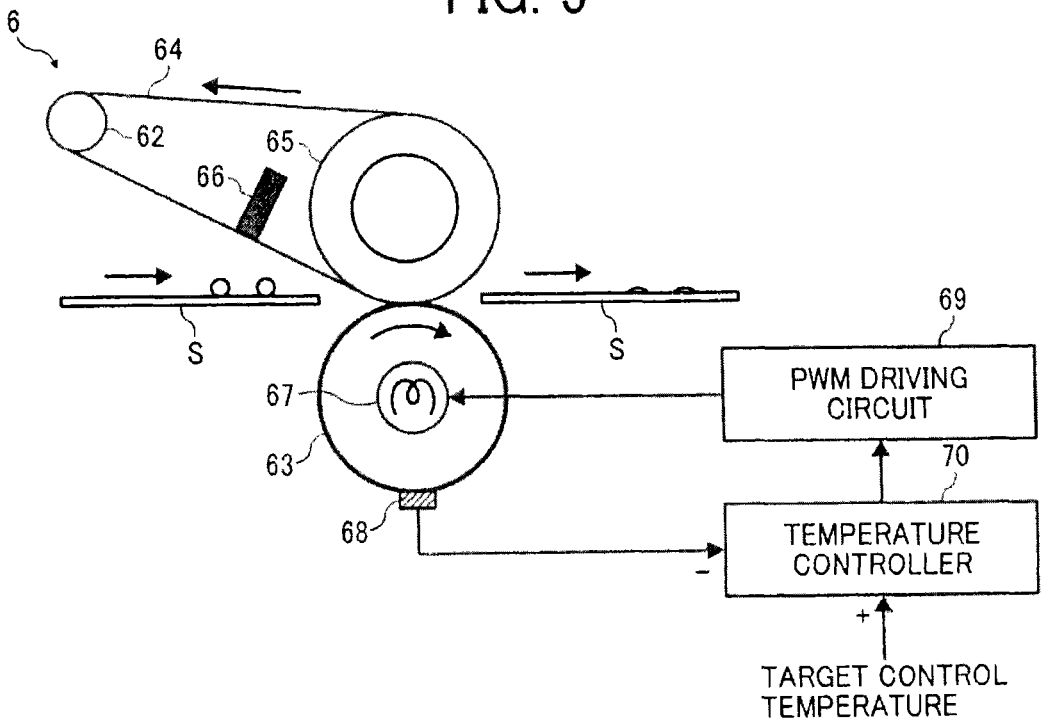
FIG. 5 schematically illustrates a configuration of the fixing device of FIG. 1.

Further, when the pressing roller 63 is simply heated by the halogen heater 67, temperature thereof is either excessively or insufficiently increased. Thus, the halogen heater 67 needs to be controlled to heat the pressing roller 63 in a manner as described below with reference to FIG. 5.

As shown, a fixing device 6 includes a contact type thermistor (TM) 68 to detect temperature of the pressing roller 63, a PWM driving circuit 69 to drive the thermistor (TM) 68, and a heat controller 70 to control temperature of the pressing roller 63 by changing a power distribution (so called duty) per hour to control application of power to the halogen heater 67 using the PWM circuit 69 based on information between a target control temperature previously designated for the pressing roller 63 and that detected by the thermistor (TM) 68.

The above-described target control temperature satisfies both temperatures of the sheet-toner boundary face and the second boundary face described earlier. Since surface temperature of the pressing roller 63 is detected by the thermistor (TM) 68 and is controlled based on the detection result thereof, the temperature inclination appearing over the fixing belt 64 and the pressing roller 63, which determines the sheet-toner boundary face temperature that greatly affects a fixing performance, becomes precisely controlled as shown in FIG. 4C, and thereby capable of executing preferable fixing. In short, the PWM driving circuit 69 and the temperature controller 70 can provide one of the functions of the control device.

As described heretofore, both the fixing performance and the glossiness can be satisfied at the same time while suppressing waste of energy. Instead of the above-described contact type thermistor (TM), a non-contact type thermistor (TM) or thermopile can be employed.

Now, yet another modification is described. When the halogen heater 67 uniformly internally heats the pressing roller 63 in a rotational direction thereof, a certain amount of power may be yet wasted.

Figure 6:
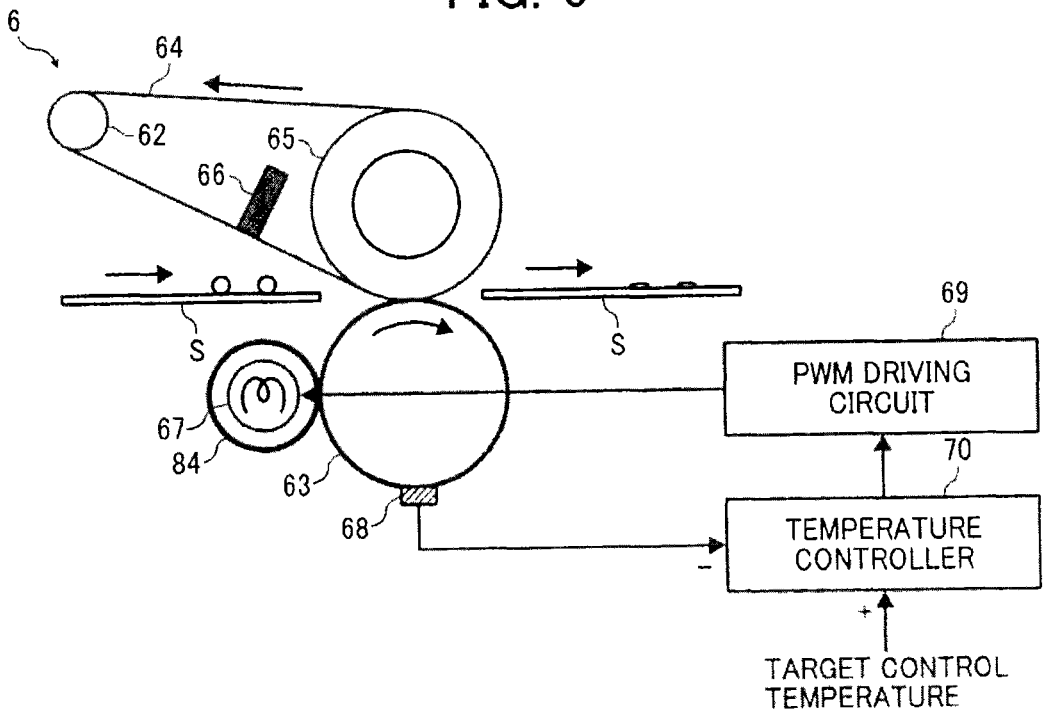
FIG. 6 schematically illustrates another exemplary configuration of the fixing device included in the image forming apparatus of FIG. 1.

To resolve such a problem, a halogen heater 67 is disposed at an outside of the pressing roller 63 to externally heat thereof, so that the pressing roller 63 can be heated omitting the heat wasted when internally applied thereto as shown in FIG. 6.

Specifically, the fixing device 6 is composed of a thin hollow cylindrical heat roller 84 that contacts and is driven and rotated by the pressing roller 63. A halogen heater 67 as an external heat source is disposed at a rotation center of the thin hollow cylindrical heating roller 84, so that heat is conveyed from the halogen heater 67 to the pressing roller 63 via the heat roller 84 to increase surface temperature of the pressing roller 63. The rest of the above described devices and operations are as same as the above-described fixing device 6. However, the pressing roller 63 can be a type other than the hollow one.

With such a configuration, energy for appropriately keeping a prescribed temperature of a portion initially receiving heat from the thermal head at a fixing nip can be more effectively saved while maintaining the above-described advantages.

Now, yet another exemplary modification is described hereinafter. Due to entire heating in an axis direction of the pressing roller 63, a certain amount of power may be yet consumed even applied from the outside thereof.

Figure 7:
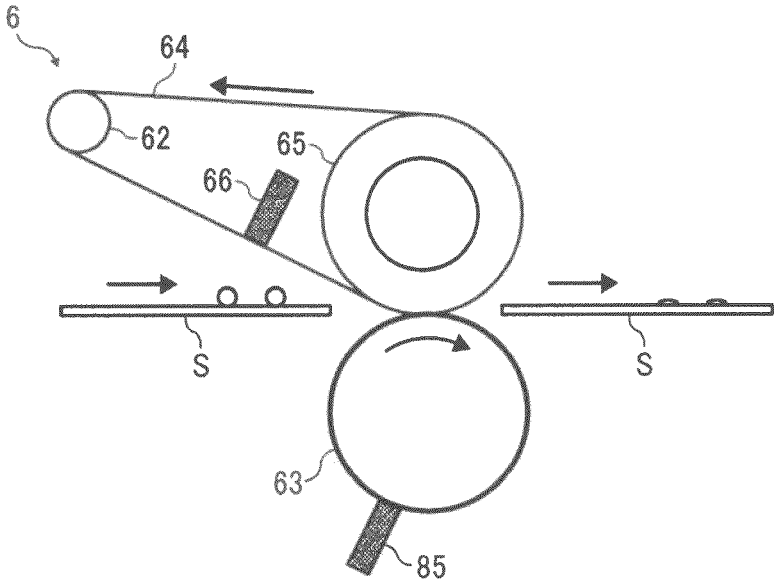
FIG. 7 schematically illustrates yet another exemplary configuration of the fixing device included in the image forming apparatus of FIG. 1.

To resolve such a problem, a thermal head 85 as a heating device locally heats a pressing roller 63 to save power as shown in FIG. 7. A manner of heating the pressing roller 63 by the thermal head 85 is substantially the same as even from the outside 66 heats the fixing belt 64 as described earlier. Even though, the thermal head 85 is disposed at an outside of the pressing roller 63 in the above described modification, it can be installed to internally heat thereof. Instead of the thin hollow cylindrical shape, the pressing roller 63 can employ the other shape as far as being externally disposed as in this modification. The rest of the above-described devices and operations are the same as in the earlier described fixing device 6.

With this modification, the energy save is more effectively achieved than the above-described several modifications.

Figure 8:
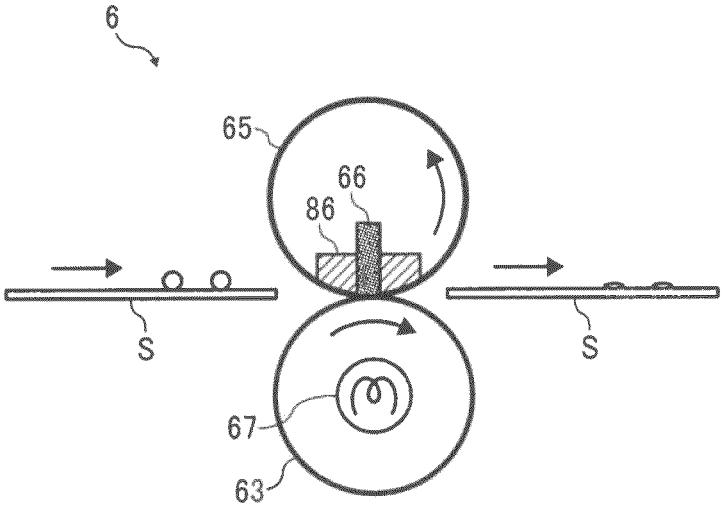
FIG. 8 schematically illustrates yet another exemplary configuration of the fixing device included in the image forming apparatus of FIG. 1.

Instead of the belt fixing system as described above, a heat roller type fixing system can be employed as shown in FIG. 8. Specifically, a fixing roller 65 having an endless surface includes a thermal head 66 that internally locally heats the fixing roller 65 in a fixing nip. Material or the like of the fixing roller 65 may be as substantially the same as the fixing belt 64. Further, the fixing device 6 includes a supporting member 86 that supports the thermal head 66 facing the pressing roller 63 so that respective heater elements included therein contact the inner surface of the fixing roller 65. Thus, the supporting member 86 is configured to form a fixing nip on the pressing roller 63. A thermister 68, a PWM driving circuit 69, a temperature controller 70, not shown, are employed to execute the above-described control while omitting the tension roller 62 or the fixing belt 64.

With this modification, the above-described several advantages may be maintained. Instead of the above-described pressing roller 63 as same as that of FIG. 5, the other pressing roller 63 of FIGS. 6 and 7 can be employed.

Now, an exemplary temperature control executed by a temperature controller 70 for controlling the pressing roller 63 is described. As already described earlier, a target control temperature of the pressing roller 63 is appropriately determined to satisfy both temperatures of the sheet-toner boundary face and the second boundary face. Such a target control temperature may be constant or is changed in accordance with a thickness of the transfer sheet S or that of a toner particle borne thereon as described below with reference to FIGS. 9 to 10.

As shown in FIGS. 9A and 9B, two situations are illustrated in each of the drawings.

That is, in an upper part of FIG. 9A, heat transition is illustrated from an initial state and to the end of nipping of a sheet S bearing a toner image in a fixing nip on conditions that the sheet is thin, temperature of a fixing belt is initially 140 degree centigrade, that of the thin sheet is 20 degree centigrade, and that of a pressing roller is 20 degree centigrade, wherein smaller dots represent initial temperature of respective devices and a thin oblique line represents a condition after heat transition In the lower part of FIG. 9A, heat transition is illustrated at the same situation on conditions that the sheet is thin, temperature of a fixing belt is initially 140 degree centigrade, that of the thin sheet is 20 degree centigrade, and that of a pressing roller is 60 degree centigrade wherein larger dots represent initial temperature of respective devices and a thick oblique line represents a condition after heat transition FIG. 9B similarly illustrates heat transition patterns when a thick sheet S is passes through a fixing nip on the same conditions as described above.

Further understood is that a temperature rising level decreases at the boundary face due to a depth of heat penetration. Accordingly, to increase temperature at the sheet-toner boundary face without increasing the second boundary face, temperature of the pressing roller 63 needs to be increased in proportion to the thickness of the transfer sheet S.

To achieve such a goal, a target control temperature is changed in accordance with the thickness of the transfer sheet S. For this purpose, information related to the thickness of the transfer sheet S may be obtained based on sheet type information inputted through a sheet type inputting key disposed on an operation panel. Accordingly, the sheet type input key serves as a sheet thickness determiner. As seen in a general image forming apparatus, information of a thickness of a transfer sheet S is obtained before the transfer sheet S enters a fixing device 6 after image formation is requested by depressing a start switch disposed on an image forming apparatus 100. Such thickness information can be obtained based on an input through the sheet type input keys serving as a sheet thickness determiner as in this embodiment, or from a sheet thickness determiner disposed on either a sheet feeding device 61, a manual sheet feed tray 53, a sheet conveyance path 81, or a sheet path 82 disposed upstream of the fixing device 6 or the like. Such information is generally roughly obtained in machines spreading in offices and is categorized to thin, normal, and thick sheets or the like.

A target control temperature is designated and utilized by a temperature controller 70 for controlling a pressing roller 63 with reference to a table shown in FIG. 10. Specifically, target control temperatures for the pressing roller 63 are previously determined in accordance with the sheet categories, and one of them is selected immediately when the information related to the thickness of the transfer sheet S is obtained. Then, heat control is executed so that the temperature of the pressing roller 63 becomes the target control level.

To immediately change temperature of the pressing roller 63 upon receiving the sheet information, the configuration of FIG. 6 or 7 which externally heats the pressing roller 63 is desirous in view of a quick response to temperature increase. It is also effective to previously heat the pressing roller 63 up to about 60 degree centigrade as the practically lowest temperature used for a thin paper regardless of sheet information for the purpose of decreasing a user waiting time.

Now, an exemplary operation for designating a target control temperature in accordance with a thickness of a toner layer borne on a transfer sheet S is described.

As the same in the thickness of the transfer sheet S, as a thickness of toner particles increases thereon, calorie provided to the sheet-toner boundary face decreases and a temperature rising level also decreases there. To resolve such a problem, a target control temperature is changed for a pressing roller 63 in accordance with information of a thickness of the toner layer.

The thickness of a toner image is different when a monochrome image is formed from when a color image is formed. Specifically, the monochrome image only includes one layer, while the full color image includes two or more layers. Information representing one of the monochrome image and the full color image may be readily obtained by a control device before a transfer sheet S enters a fixing device 6. Thus, as substantially the same as that described above with reference to the table of FIG. 10, a similar table designating plural target control temperatures for a pressing roller 63 is prepared for respective monochrome and color image formations, and are selectively used to executed preferable fixing.

Such tables may be stored in a memory disposed in the control device, so that a target control temperature is selected by the control device. Thus, the control device serves as a target designation temperature storage and a target design temperature selecting device. Further, the target design temperature can preferably be constituted by a combination of the thickness of the transfer sheet S and the toner particles borne thereon.

Even though the contact type thermal head is used in the above-described modifications to locally heat the fixing member, a non-contact type halogen or ceramic heater or the like with heat radiation can be employed to heat a fixing member. Alternatively, an IH (induction heating) system of a self heat generation type can be employed. When the halogen heater or ceramic heater is employed as a first heating device, the halogen heater or ceramic heater is divided into plural pieces to be disposed in a widthwise direction of the fixing member, so that the fixing member is locally heated both in widthwise and rotational directions by selectively driving pieces of the halogen heater in accordance with a toner bearing region as an image region on the transfer sheet S.

Whereas, when the IH system is employed as a first heating device, a coil is divided into plural pieces to be disposed in a widthwise direction of the fixing member, and the fixing member is locally heated both in widthwise and rotational directions by selectively driving the pieces of the coil in accordance with a toner bearing region as an image region on the transfer sheet S.

The image forming apparatus can be a tandem type and employ a direct transfer system beside the indirect transfer system as described above. In the direct transfer system, a sheet conveyance belt for conveying a recording medium as an image bearer is employed and respective monochrome color toner images formed in image formation stations 60Bk to 60Y are sequentially superimposed thereon during transportation by the sheet conveyance belt.

Further, the above-described image forming apparatus can employ single drum system instead of the above-described tandem system, in which a color image is formed by sequentially superimposing respective monochrome color toner images thereon.

The image forming apparatus can be a type only forming a monochrome toner image.

One component developer can be employed instead of two component developer in the above-described image forming apparatus. The image forming apparatus can form a toner image with ink rather than the toner as described above.

The image forming apparatus can be a stand alone type rather than a combined machine type that combines with a copier, a printer, and a facsimile machine or the like.

Numerous additional modifications and variations of the present invention are possible in latent image of the above teachings. It is therefore to be understood that within the scope of the appended claims, the present invention may be practiced otherwise that as specifically described herein.

What is claimed is:

1. A fixing apparatus comprising:

a fixing member to fix a toner image onto a recording medium;

a pressing member to press the recording medium against the fixing member at a nip portion;

a first heater to locally heat the fixing member by providing heat upstream of the nip portion to a portion of the fixing member corresponding to a position of the toner image on the recording medium;

a second heater to heat the pressing member;

a temperature detector to detect a temperature of the pressing member; and a temperature control device including a memory with a table stored in the memory relating target control temperatures with thicknesses of toner layers, wherein the temperature control device obtains information including a thickness of a toner layer carried on the recording medium, wherein the temperature control device controls the temperature of the pressing member to a target control level by controlling the second heater based on the temperature detected by the temperature detector and a target control temperature in the table corresponding to the thickness of the toner layer carried on the recording medium, wherein the second heater includes a plurality of heater elements arranged in a widthwise direction of the fixing member, and wherein the second heater locally heats the pressing member by providing heat in the widthwise direction with heater elements corresponding only to a portion of the pressing member corresponding to the toner image.

2. The fixing apparatus as claimed in claim 1, wherein said second heater is disposed against an external surface of the pressing member.

3. The fixing apparatus as claimed in claim 1, wherein said pressing member is composed of a hollow roller, and said second heater is disposed inside the hollow roller.

4. The fixing apparatus as claimed in claim 1, wherein said target control level is determined in accordance with the thickness of the toner layer carried on the recording medium and a thickness of the recording medium.

5. The fixing apparatus as claimed in claim 1, wherein said temperature of the pressing member is a surface temperature of the pressing member.

6. An image formation system for forming an image, comprising:

a toner image forming apparatus to form a toner image; and the fixing apparatus as claimed in claim 1, said fixing apparatus fixing the toner image.

7. The fixing apparatus as claimed in claim 1, wherein said fixing member comprises:

a fixing roller; and a support member disposed inside of the fixing roller, wherein said first heater is disposed inside the fixing roller and contacts an inner surface of the fixing roller, and said support member forms a fixing portion with the pressing member and supports the first heater inside of the fixing roller.

8. The fixing apparatus as claimed in claim 1, wherein said pressing member is composed of a hollow roller, and said second heater is disposed against an external surface of the hollow roller.

9. The fixing apparatus as claimed in claim 8, wherein said target control level is determined in accordance with the thickness of the toner layer carried on the recording medium and a thickness of the recording medium.

10. The fixing apparatus as claimed in claim 1, wherein a second table that relates second target control temperatures with thicknesses of recording mediums is stored in the memory of the temperature control device, wherein the target control level is determined based on the target control temperature and a second target control temperature corresponding to a thickness of the recording medium.

* * * * *